United States Patent [19]

Ivey

[11] Patent Number: 4,822,208

[45] Date of Patent: Apr. 18, 1989

[54] ADVANCED DYNAMIC IMPACT EXTENSION MODULE

[75] Inventor: Don L. Ivey, Bryan, Tex.

[73] Assignee: The Texas A&M University System, College Station, Tex.

[21] Appl. No.: 124,499

[22] Filed: Nov. 23, 1987

[51] Int. Cl.[4] ..... E01F 13/00; E01F 15/00

[52] U.S. Cl. ..... 404/6; 256/13.1; 188/377

[58] Field of Search ..... 404/6, 9, 10; 256/1, 256/13.1; 52/174; 188/371, 377; 49/9

[56] References Cited

U.S. PATENT DOCUMENTS

| | | | |
|---|---|---|---|
| 1,551,556 | 9/1925 | Gust | 404/6 X |
| 1,940,994 | 12/1933 | Callaghan | 404/6 |
| 3,141,655 | 7/1964 | Platt | 256/13.1 X |
| 3,880,404 | 4/1975 | Fitch | 404/6 X |
| 3,881,697 | 5/1975 | Glaesner | 256/13.1 |
| 3,967,704 | 7/1976 | Ogden | 188/377 X |
| 4,047,701 | 9/1977 | Glaesner | 256/13.1 |
| 4,073,482 | 2/1978 | Seegmiller et al. | 404/6 X |
| 4,289,419 | 9/1981 | Young et al. | 404/6 |
| 4,290,585 | 9/1981 | Glaesner | 404/6 X |
| 4,321,989 | 3/1982 | Meinzer | 256/13.1 X |
| 4,399,980 | 8/1983 | van Schie | 188/377 X |
| 4,423,854 | 1/1984 | Cobb et al. | 256/13.1 |
| 4,552,341 | 11/1985 | Zucker et al. | 256/13.1 X |
| 4,681,302 | 7/1987 | Thompson | 404/6 X |

OTHER PUBLICATIONS

Evaluation of Crash Cushions Constructed of Lightweight Cellular Concrete, Ivey, et al., 1972 Highway Research Record No. 386 (pp. 10, 11, 17, 18).

Crash Tests of an Articulated Energy-Absorbing Gore Barrier Employing Lightweight Concrete Cartridges, Walker, et al., 1972 Highway Research Record No. 386 (pp. 19, 20, 22).

Feasibility of Lightweight Cellular Concrete for Vehicle Crash Cushions, Ivey, et al., Committee on Guardrail, Median Barriers and Sign, Signal and Lighting Supports (First and Last Page of Article).

*Primary Examiner*—Jerome W. Massie
*Assistant Examiner*—John F. Letchford
*Attorney, Agent, or Firm*—Arnold, White & Durkee

[57] ABSTRACT

An advanced dynamic impact extension module, used to protect occupants of vehicles from the adverse effects of instantaneous deacceleration of a vehicle when the vehicle impacts an end of a concrete barrier wall is disclosed. According to the invention, a composite barrier is provided which has an upper, low density, crushable component and a lower, substantially non-crushable, base component. The height of the base component will increase from the front of the barrier to the back of the barrier, located proximate the end of the concrete barrier wall, so that a vehicle impacting the barrier will first crush the upper, low-density, crushable material. If a vehicle has sufficient impact force or velocity to crush the upper crushable front component of the barrier, the undercarriage of the vehicle will coact with raised non-crushable base components of the barrier in order to bring the vehicle safely to rest before it impacts the end of a concrete barrier wall. The non-crushable base component of intermediate sections of the barrier will increase in height in step wise fashion so that as a vehicle passes through the barrier, the raised base portions of the barrier coact with the bottom, or undercarriage, of the vehicle to create friction and drag between the bottom of the vehcle and the base component of the barrier to thereby bring the vehicle to rest before it impacts the end of a concrete barrier wall.

15 Claims, 4 Drawing Sheets

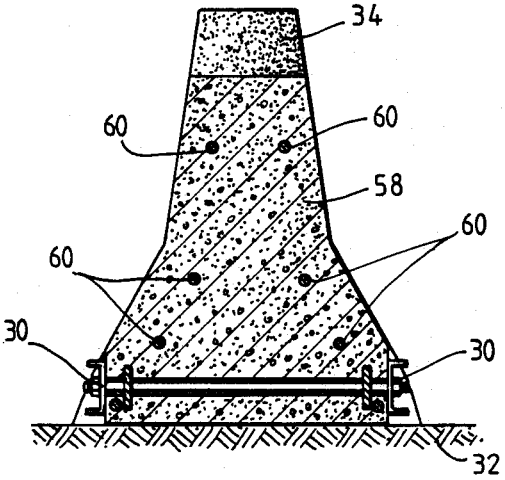
Fig. 5
Fig. 6
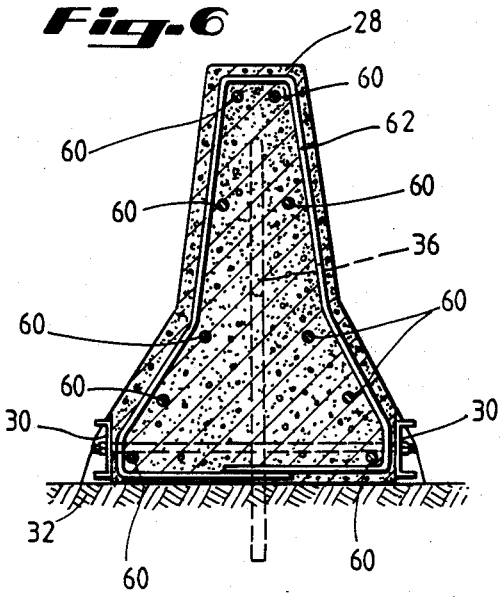
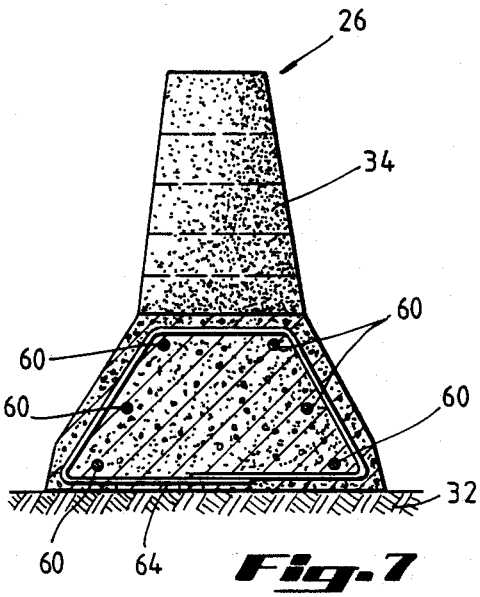
Fig. 7
Fig. 8
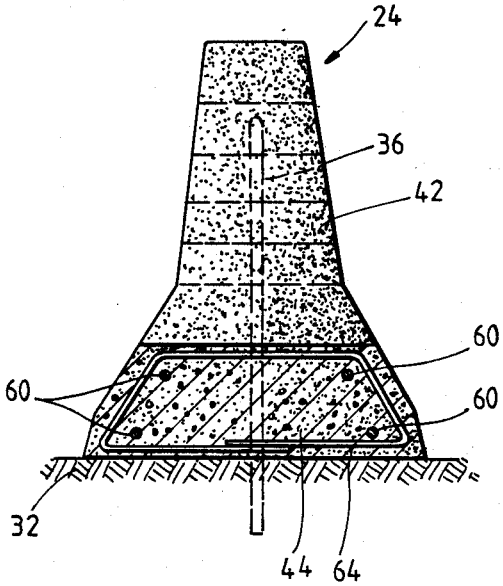

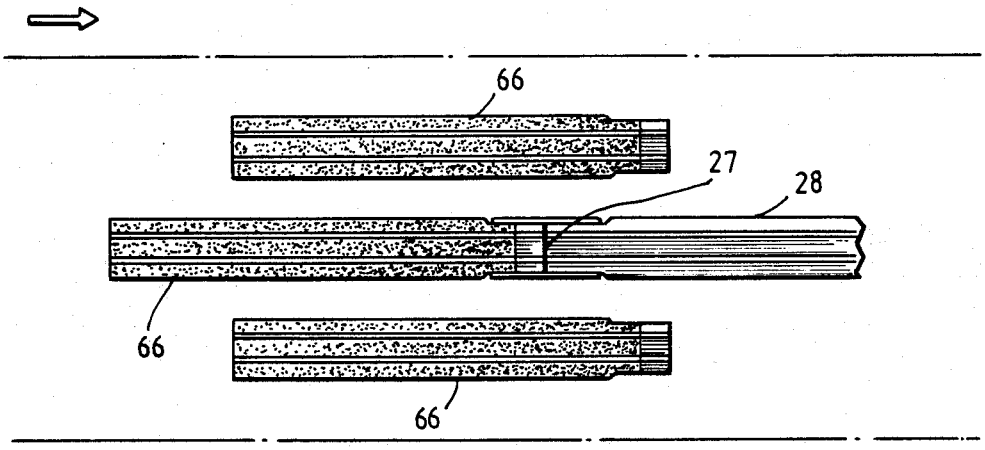
Fig. 9
Fig. 10
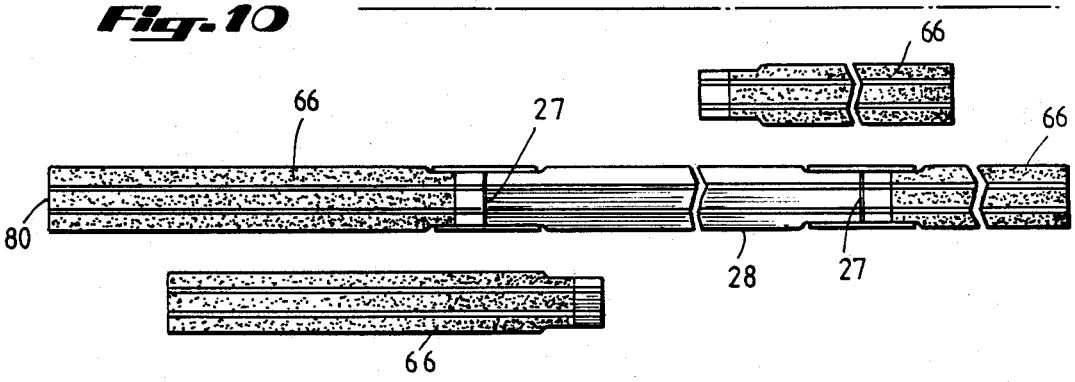
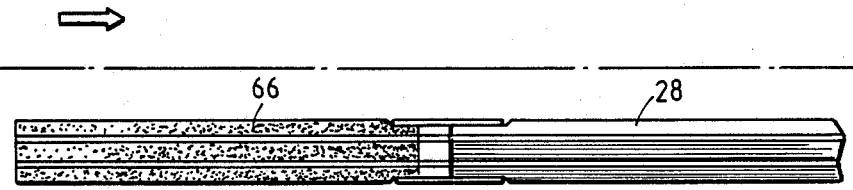
Fig. 11

ADVANCED DYNAMIC IMPACT EXTENSION MODULE

BACKGROUND OF THE INVENTION

The present invention relates generally to roadside or roadway barriers used to prevent vehicles from crossing from the lane of traffic that they are traveling in to an opposite lane, carrying vehicles traveling in an opposite direction. The present invention also relates to barrier modules which prevent vehicles from entering into any hazardous area on the roadway. In this manner, roadway barriers prevent head-on collisions on the highways and collisions with other hazardous objects. The present invention also relates to roadside barriers which prevent vehicles from leaving the highway and colliding with fixed roadside obstacles.

Specifically, the present invention relates to an improvement in the end treatment of a concrete barrier wall. The apparatus according to the present invention is specifically designed to reduce the chances of serious injury to the occupants of a vehicle which impacts an end of a concrete barrier wall.

The primary function of a concrete barrier wall is to redirect errant vehicles back into the flow of traffic without allowing the vehicle to leave the roadway or cross into oncoming lanes of traffic. Further, the barrier should redirect the errant vehicle without seriously injuring the occupants of the vehicle. Secondarily, the barrier should also protect against collisions with roadside obstructions, which may be power poles or bridge abutments. Protection of the obstruction may also be important, for a power pole downed by an errant vehicle may mean a loss of electrical power for large numbers of people. Similarly, a damaged bridge abutment is very costly to repair and may mean closed thoroughfares until the damage has been repaired. Most importantly, however, concrete barriers prevent loss of life caused by "head-on" collisions between vehicles. And, although known prior art barriers have accomplished these objectives, they have all been marked by a common, serious disadvantage. The blunt end of the concrete barrier, facing the oncoming traffic, has proven to be very hazardous.

Typically, the end of a concrete barrier wall has been either a blunt, fist shaped end; a blunt end protected by disposable, "single-event" cushion; or an end protected by a sloping concrete or metal guardrail end-treatment. All of these know barrier wall end-treatments have proven to be unsatisfactory, either for economic or functional reasons.

The known blunt end-treatments for concrete barrier walls have proven to be unsatisfactory because a vehicle impacting the blunt end "head-on", is stopped so abruptly that the occupants of the vehicle are most often severely injured or even killed. In a similar manner, many disposable "single-event" cushions used to protect these blunt barrier wall ends have proven to be ineffectual for the same reason. Further, other known "single-event" cushions have proven to be unsatisfactory because they are only partially effective when a vehicle impacts the end of a barrier wall at a high rate of speed. The few known "single-event" cushions that do perform well are extremely costly.

Finally, concrete or metal guardrail end-treatments, which provide a top surface which slopes gently from the ground up to the top of the concrete barrier wall, often causes severe injury to the occupants of a vehicle which, when encountering this sloping end treatment, ramps up onto the end treatment and is guided directly to the top of the concrete barrier wall where the concrete barrier wall acts as a rail which will often either: (a) cause the vehicle to roll, thereby causing injury to the occupants of the vehicle; or (b) guide the errant vehicle directly into a roadside obstacle, thereby severely injuring the occupants of the vehicle when the vehicle impacts the obstacle.

The known concrete barrier wall end-treatments of the prior art, therefore, have all been distinguished by a fundamental drawback: thy are unable to deaccelerate a vehicle impacting the end of a concrete barrier wall in such a manner so as to avoid serious injury to the occupants, or they do so at a cost that is unreasonable from a societal investment standpoint.

SUMMARY OF THE INVENTION

The present invention deals with the previously marginally solved problem of prior art concrete barrier wall end-treatments, by providing an advanced dynamic impact extension module which, when placed before the end of a concrete barrier wall, protects the occupants of a vehicle by progressively absorbing the force of impact of the vehicle before the vehicle reaches the end of the concrete barrier wall. A roadside barrier according to the present invention is also able to be quickly and inexpensively installed at the end of a concrete barrier wall, and may be manufactured at a site remote from the concrete barrier wall to which it is attached.

In accordance with the preferred embodiment of the present invention, a number of barrier modules, having cross-sections somewhat similar to the concrete barrier wall which they protect, are arranged linearly, in an array extending away from the end of the concrete barrier wall, in a direction leading parallel to, and toward the flow of traffic.

The sections are preferably arranged so that the longitudinal axes of the sections are aligned with one another and are also aligned with the longitudinal axis of the concrete barrier wall which they protect.

According to this embodiment of the present invention, a first roadside barrier section is a composite section comprised of reinforced concrete and a low density crushable material placed atop the reinforced concrete base. This first section is configured to closely match the existing concrete barrier wall so that the cross-section of this first section is substantially identical to the cross-sectional configuration of the concrete barrier wall which it protects.

In further accordance with the present invention, a plurality of intermediate sections are positioned linearly between the first composite section and the end of the concrete barrier wall. These intermediate sections are distinguishable in that the proportion of lower density, crushable material to reinforced concrete in each section decreases as the sections are placed closer to the end of the concrete barrier wall. In this manner, the first composite section is comprised of substantially all low density, crushable material while the last intermediate section, positioned immediately adjacent the end of the concrete barrier wall, is, at its back end, entirely reinforced concrete. Therefore, the amount of reinforced concrete in these intermediate sections increases from the first composite section to the last intermediate section positioned adjacent the end of the concrete barrier wall.

In accordance with the present invention, the lower density, crushable material is positioned above the reinforced concrete base of the roadside barrier so that a vehicle impacting the barrier will first encounter the crushable material which will tend to decrease the forward velocity of the vehicle and perhaps even stop the vehicle. If, however, the vehicle is traveling with sufficient velocity so that the vehicle crushes all of the crushable material provided in the first composite section of the roadside barrier, the vehicle will continue to crush the lower density, crushable material provided in each of the intermediate sections. As the vehicle moves through each of the intermediate roadside barrier sections, crushing the crushable material in its path, the undercarriage of the vehicle will also encounter, in step-wise fashion, greater heights of non-crushable, reinforced concrete provided in the lower, base portions of the intermediate sections of the roadside barrier. In this manner, as the vehicle passes through these intermediate sections and is slowed by the force required to crush the lower density, crushable material provided in the sections, the velocity of the vehicle will be further reduced by friction and drag produced on the bottom of the vehicle by the increased heights of the non-crushable, reinforced concrete bases of these sections acting on the vehicle.

Therefore, in accordance with the present invention, a vehicle impacting the roadside barrier in a "head-on" configuration will be brought to a stop safely before it encounters the end of the concrete barrier wall. Further, the action of the vehicle crushing the lower density, crushable material will act to prohibit the vehicle from being launched over the roadside barrier into opposing lanes of traffic.

Finally, in accordance with the present invention, the lower density, crushable material used at the top of each of the barrier wall sections will be of sufficient strength to enable the roadside barrier according to the present invention to act in a manner similar to a concrete barrier wall to deflect vehicles impacting the roadside barrier at acute angles.

BRIEF DESCRIPTION OF THE DRAWINGS

FIG. 5 is a cross-sectional view of the end of the module depicted in FIG. 2.

FIG. 6 is another cross-sectional view of the end of the module depicted in FIG. 2.

FIG. 7 is a cross-sectional view taken through the final section of the module depicted in FIG. 2.

FIG. 8 is a cross-sectional view of an intermediate section of the module depicted in FIG. 2.

FIG. 9 is a plan view showing an embodiment of the present invention protecting the end of a concrete barrier wall.

FIG. 10 is a plan view of an alternate arrangement of embodiments of the present invention.

FIG. 11 is a plan view of yet another alternate arrangement of embodiments of the present invention.

DETAILED DESCRIPTION OF THE PREFERRED EMBODIMENT

Figure 2:
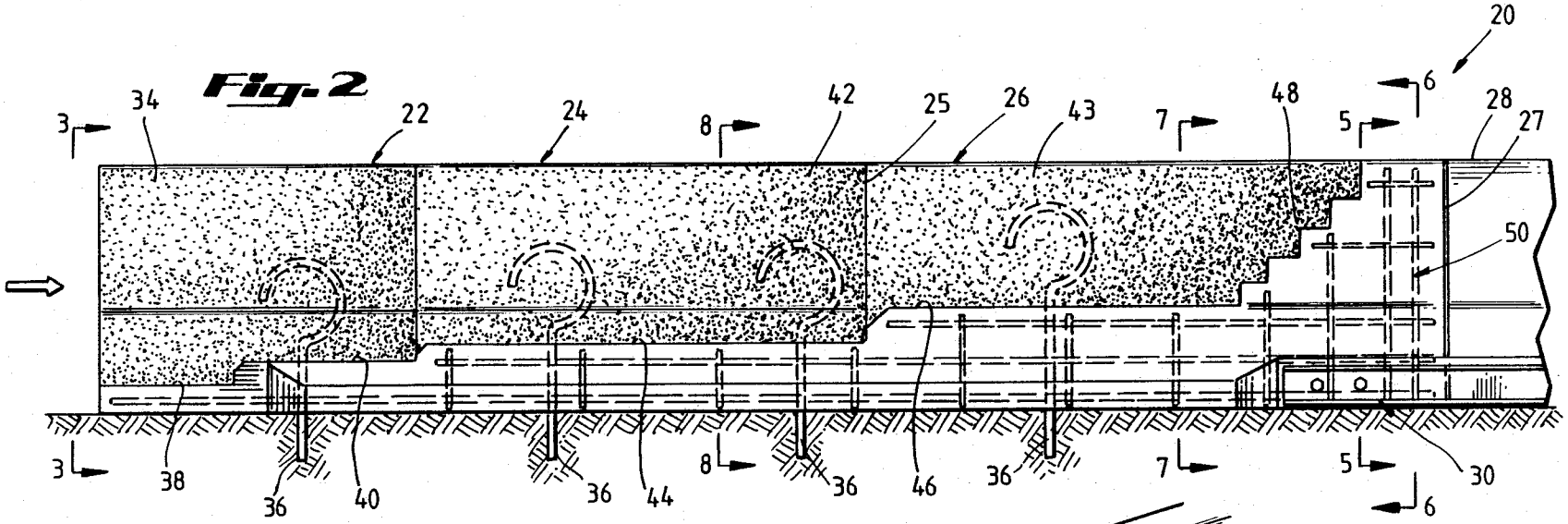
FIG. 2 is a detailed side view of a preferred embodiment of the advanced dynamic extension module according to the present invention.
Figure 3:
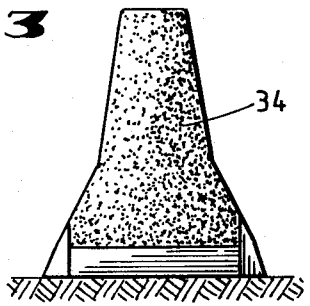
FIG. 3 is a cross-sectional view of an intermediate section of the advanced dynamic impact extension module depicted in FIG. 2.

Referring to FIG. 2, a preferred embodiment of an advanced dynamic impact extension module, or roadside barrier, according to the present invention is shown. In this embodiment, a plurality of linearly arrayed barrier wall sections; denoted as 22, 24 and 26 are positioned immediately in front of an end 27 of a concrete barrier wall 28. Referring now to FIG. 3, which is a view taken along section 3 of FIG. 2, it is shown that the several sections of the roadside barrier according to the present invention have a substantially identical cross-sectional configurations, which in turn are substantially identical to the cross-sectional configuration of the concrete barrier wall 28.

Referring again to FIG. 2, in accordance with this embodiment of the present invention, a first section 22 is a composite section comprised of a reinforced concrete portion 38 and 40 and a lower density, crushable material portion 34. The lower density, crushable material portion 34 is positioned above the reinforced concrete surfaces 38 and 40. In this embodiment of the invention, the lower density, crushable material 34 positioned above the reinforced concrete surfaces 38 and 40 will comprise at least two-thirds of the cross-sectional volume of the first section.

Referring still to FIG. 2, the roadside barrier 20 according to the present invention will be provided with at least one intermediate section 24. The intermediate sections 24 are also composite sections wherein a lower portion 44 of each section 24 is comprised of reinforced concrete while an upper portion of 42 of each section is comprised of lower density, crushable material. Each intermediate section 24 is further characterized in that sections located near the first section 22 of a roadside barrier are comprised of a greater volume of low density, crushable material 42 than are the sections positioned closer to the end 27 of the concrete barrier wall 28 which the roadside barrier 20 protects.

In this manner, the composition, and hence the proportion, of crushable material to reinforced concrete varies in each intermediate section 24 so that the intermediate sections 24 are comprised of a progressively lesser volume of low density, crushable material 42 as the linear distance from the first section 22 to each intermediate section 24 increases. In accordance with the present invention, the low density, crushable material 34 of the first section and the low density, crushable material 42 of each intermediate sections are bonded to the reinforced concrete base of each section.

Referring still to FIG. 2, in an alternate embodiment of the present invention, reinforcing steel 36 is formed in the reinforced concrete sections 38, 40 and 44 so that a hooked portion of the reinforcing steel extends upwardly beyond the upper surface 38, 40 and 44 of the reinforced concrete. Thereafter, when the lower density, crushable material is formed in place on top of the reinforced concrete and is attached to the reinforced concrete, the lower density, crushable material will be further supported by the reinforcing steel 36, attached to the reinforced concrete.

Referring still to FIG. 2, the roadside barrier 20 is further provided with a final barrier section 26. Final barrier section 26 has a front end 25, positioned toward the intermediate barrier sections 24 and a back end 48 positioned linearly, distally from the first section. In a most preferred embodiment of the present invention, the reinforced concrete 46 provided along the base of the final roadside barrier section 26 will increase rapidly in a stepped configuration through the longitudinal width of the final section 26 as depicted in FIG. 2 at numeral 48. Therefore, a vehicle passing through the first section 22 and all intermediate sections 24 will finally encounter the final roadside barrier section 26, the front end of the vehicle coming to rest at the rear, stepped portion 48 of the final barrier section 26.

In this embodiment of the present invention, the cross-sectional volume of the front end 25 of the final section 26 is comprised of approximately half reinforced concrete 46, positioned along the bottom of the section 26, and half low density, crushable material 43 placed above, and on top of, the surface of the reinforced concrete base 46 of the final section 26. As depicted in FIG. 2, the final roadside barrier section 26 will, at its back end 48, be comprised entirely of reinforced concrete. This further enables the roadside barrier 20 to be fixedly attached to the leading end 27 of a concrete barrier wall 28.

Figure 4:
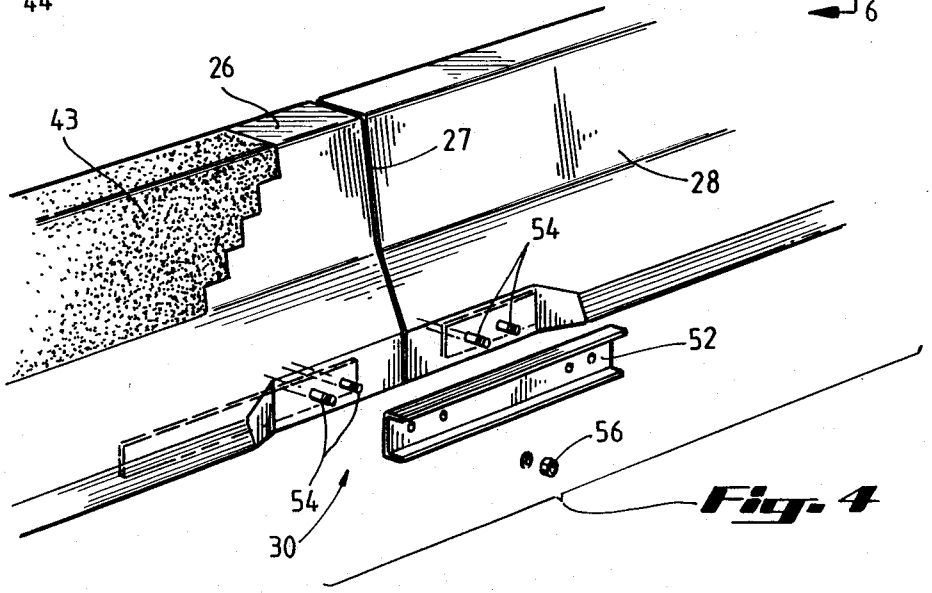
FIG. 4 is a perspective view of a final section of the advanced dynamic impact extension module depicted in FIG. 2 showing it attached to the end of the concrete barrier wall which it protects.

Referring to FIG. 4, a partially exploded perspective view of the final section 26 and the end 27 of a concrete barrier wall 28 is shown. As noted at 30 in FIG. 4 (and at numeral 30 in FIG. 2) the final section 26 of the roadside barrier 20 is preferably fixedly attached to the end 27 of a concrete barrier wall 28. In the embodiment shown, a channel-shaped splicing member 52, is provided with apertures to receive lag bolts 54 formed in the reinforced concrete of both the final section 26 of the roadside barrier, and the concrete barrier wall 28. In this embodiment, fasteners 56 are applied to the lag bolts 54 to secure a channel-shaped member 52 to the roadside barrier and to the concrete barrier wall. In a preferred embodiment of the present invention, each individual section of the advanced dynamic impact extension module 20 are also joined together, and may be so joined in a manner similar to the method used to join the module 20 the concrete barrier wall 28 (as indicated in FIG. 4).

Referring now to FIGS. 1A through 1D, the individual sections 22, 24, and 26 of a roadside barrier 20 according to the present invention are arranged in a linear array so that a vehicle 10 impacting the first section 22 in a "head-on" direction will encounter, in ascending order, a step-wise array of lower, reinforced concrete base sections as the vehicle crushes the crushable material above each reinforced concrete base portion of each section. As shown specifically in FIGS. 1C and 1D, the raised, stepped array of reinforced concrete bases of the individual barrier sections according to the present invention will coact with the undercarriage of the vehicle 10 to further impede the forward progress of the vehicle 10 as the vehicle 10 moves through the barrier 20. According to the present invention, the combined effect of the force exerted by the front of the vehicle 12 in crushing the crushable, low density material of each section, with the force expended by the vehicle 10 as the undercarriage of the vehicle 10 encounters drag caused by the raised stepped reinforced concrete portions of the individual barrier sections, coact to bring the vehicle 10 to a stop before the vehicle 10 encounters the end 27 of the concrete barrier wall 28.

Referring again to FIG. 2, in a most preferred embodiment of the present invention, the density of the lower density, crushable material 34 in the first section 22 is less than the density of the lower density, crushable material 42 located in each intermediate section 24. In a similar manner, the density of the crushable material 42 provided in each intermediate section 24 increases as the distance from each individual intermediate section 24 to the first barrier section 22 increases. Finally, the density of the lower density, crushable material 43 provided in the final barrier section 26 is greater than the density of any of the material used in the lower density, crushable portions of the intermediate sections 24.

However, it is a preferred function of the roadside barrier 20 according to the present invention that the lower density, crushable material used in each of the barrier sections 22, 24, and 26 be of sufficient strength to deflect a glancing impact from a vehicle impacting the sidewall surfaces of the barrier at an acute angle.

Referring now to FIG. 8, a cross-sectional view of an intermediate section 24 of a roadway barrier according to the present invention is depicted. As shown, the composite highway lane barrier section 24 is a composite lane barrier having a lower, substantially non-crushable base component 44 and an upper crushable top component 42. In this embodiment of the present invention, the lower substantially non-crushable base component 44 may be comprised of reinforced concrete wherein the reinforcing rods are shown at 60 and 64. In this embodiment of the present invention, the highway lane barrier rests atop the shoulder of the roadway 32, or may be conveniently placed immediately adjacent, and parallel to, the roadway.

Referring again to FIG. 2, the base component (shown at 38, 40, 44, and 46) is configured to increase in height from a front end of the barrier (shown in cross-section in FIG. 3) to a back end 48 of the barrier 20 position proximate to a leading end 27 of a conventional highway lane barrier 28. The back end 48 of the barrier 20 according to the present invention is further configured to abut the leading end 27 of the conventional concrete lane barrier 28.

In this embodiment, the upper component (denoted as 34, 42, and 42 in FIG. 2) rests upon, and is attached to, the individual base components of the barrier.

Figure 1A:
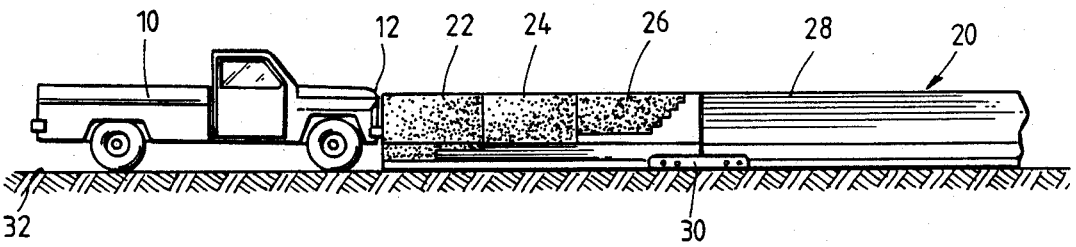
FIG. 1A is a side view depicting a vehicle which is about to impact a roadside barrier according to the present invention "head-on" direction.
Figure 1B:
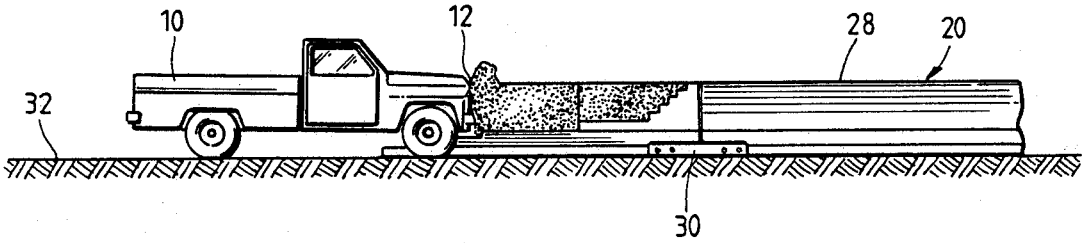
FIG. 1B is a view of the vehicle depicted in FIG. 1A which has impacted a roadside barrier according to the present invention and has crushed the lower density material positioned in a first composite section of the barrier.
Figure 1C:
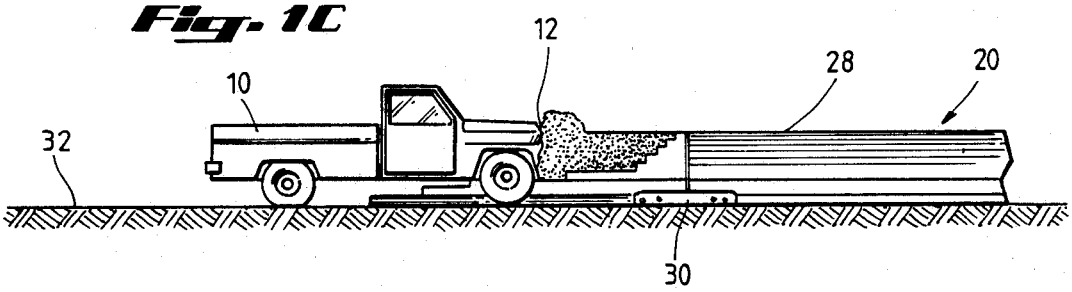
FIG. 1C is a side view of the vehicle depicted in FIGS. 1A and 1B wherein the vehicle has passed through a first composite section of a roadside barrier according to the present invention. The velocity of the vehicle in FIG. 1C is being reduced by the force required to crush the lower density, crushable material positioned in the upper portion of the intermediate section, while the velocity of the vehicle is further reduced by the coaction of the raised, reinforced concrete portion of the intermediate sections of the barrier with the undercarriage of the vehicle.
Figure 1D:
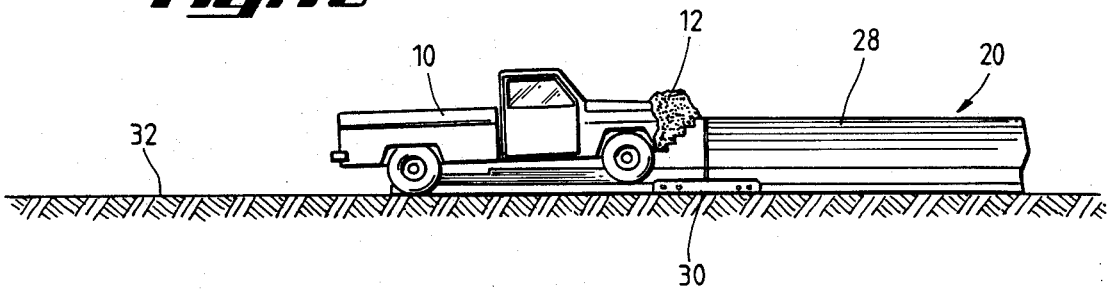
FIG. 1D is a side view of the vehicle depicted in FIGS. 1A through 1C wherein the vehicle has passed through the first composite section, and all of the intermediate sections and has finally been brought to rest before it encounters the end of the concrete barrier wall.

In the most preferred embodiment of the present invention, and as shown specifically in FIGS. 2 and 3, the height of the base component 38 of the barrier 20 at the front end of the first section 22 of the barrier is less than the road clearance of a vehicle impacting the barrier in a "head-on" direction. Roadway clearance may be defined as the vertical distance from the surface of the road to the undercarriage of a vehicle. This relationship is also clearly shown in FIG. 1B wherein a vehicle 10 is shown after impacting a barrier 20 and crushing the crushable material positioned over the base component 38 of the first section 22 of the barrier 20. In FIG. 1B, it is shown that the undercarriage of the vehicle 10 is able to clear the base component 38 of the first section 22 of the barrier 20.

In further accordance with the present invention, the height of base components 44, 46, and 48 of the intermediate sections of the barrier is greater than the road clearance of a vehicle 10 impacting the barrier. This is further shown specifically in FIGS. 1C and 1D where the undercarriage of a vehicle 10 is shown coacting with the base components to create friction and drag between the base portions and the vehicle to further impede the forward progress of the vehicle 10 as it moves through the barrier.

In the most preferred embodiment of the present invention, and as shown specifically in FIGS. 2, 3, and 5–8, the height of the base components of the barrier 20 increases in step-wise fashion from the front end of the barrier (section 22) to the back end of the barrier (section 26) as shown at 48. In this embodiment of the present invention, a plurality of intermediate sections 24 may also be provided between, and along the length of the barrier 20. These intermediate sections 24 interconnect the front section 22 with the back section 26 of the barrier. The intermediate sections 24 may further be characterized by variable density crushable top components from the front 22 of the barrier 20 to the back 48 of the barrier so that the crushable top components of the barrier crush under the influence of lesser impacting force near the front of the barrier while the crushable top components positioned near the back 48 of the barrier require significantly greater impacting force in order to be crushed. Therefore, the density of the crushable top components of the intermediate sections 24 also increases in step-wise fashion from the front of the barrier to the back of the barrier.

Referring to FIG. 9, a planar view of an array of roadside barriers 66 according to the present invention is shown. In this application of the present invention, roadway barriers 66 according to the present invention are shown positioned between parallel lanes of traffic flow denoted by the arrows. In this configuration, roadside barriers, or advanced dynamic impact extension modules 66 are placed on either side of, and in front of, and end 27 of a conventional concrete barrier wall 28. With this configuration, any vehicle, travelling in the direction denoted by an arrow, which strays from the roadway toward the end 27 of the concrete barrier wall 28, will encounter at least one module 66 which will prohibit the vehicle from impacting the end 27 of the concrete barrier wall 28 and will safely slow the vehicle without causing injury to the vehicle's occupants.

In a similar manner, FIG. 10 depicts an arrangement whereby a plurality of impact modules 66 may be arranged to protect opposed ends 27 of a concrete barrier wall 28. As shown in FIG. 10, when a concrete barrier wall 28 is used to divide opposing lanes of traffic (again as indicated by the arrows) impact modules 66 may be placed before each end 27 of the concrete barrier wall 28. Further, in this arrangement of embodiments according to the present invention, additional impact modules 66 will be placed parallel to the concrete barrier wall ends, adjacent the concrete barrier wall in a direction toward the direction of traffic. Therefore, the modules 66 protect a vehicle from by-passing the impact module 66 positioned before the end 27 of the concrete barrier wall. In this arrangement of modules embodying the present invention, the adjacently placed modules 66 are positioned slightly behind the leading edge 80 of the module 66 attached to the concrete barrier wall 28 in order to provide increased vehicle protection.

Finally, FIG. 11 depicts an alternate arrangement of an advanced dynamic impact extension module 66 according to the present invention.

Various modifications and improvements may be made to the disclosed embodiments of the present invention without departing from the overall scope and spirit of the invention. For example, various materials may be used for the lower density, crushable material such as low strength, porous concrete; styrofoams; or plastics. Further, the cross-sectional configuration of the roadside barrier itself may be varied in order to accommodate various barrier wall configurations, or to provide increased vehicle protection in areas of high traffic density and high traffic speed. In this respect, the first eight to twenty feet of the barrier module may be provided with a cross section that is different than the remaining portion of the barrier module, or the concrete barrier wall itself.

Having therefore fully and completely disclosed the best modes of my invention, I now claim:

1. A roadside barrier, adapted to prevent vehicles from impacting obstacles, including other vehicles, comprising:

a plurality of linearly arrayed barrier wall sections, each said section having a substantially identical cross-sectional exterior configuration;

a first said section being a composite section comprised of reinforced concrete and a lower density, crushable material; and wherein said lower density, crushable material is positioned above said reinforced concrete and comprises at least half of the cross-sectional volume of said first section; and a plurality of intermediate said sections, said intermediate sections being composite sections wherein a lower portion of each said section is comprised of reinforced concrete and an upper portion of each said section is comprised of a lower density, crushable material; each said intermediate section being further characterized in that the said sections located nearer said first section are comprised of a greater volume of lower density, crushable material than the said sections positioned further away from said first section.

2. The barrier according to claim 1, wherein the composition of each said intermediate section varies so that the intermediate sections are comprised of a progressively lesser volume of lower density, crushable material as the linear distance from said first section to each said intermediate section increases.

3. The barrier according to claim 1, wherein said lower density, crushable material of each said section in said linear array is attached to the said reinforced concrete of said section.

4. The barrier according to claim 1, wherein said barrier is provided with a final barrier section having a front end and a back end positioned linearly, distally from said first section; wherein the cross-sectional volume of said front end of said final section is composed of approximately half reinforced concrete, positioned along the bottom of said section, and half lower density, crushable material, positioned above, and on top of, said reinforced concrete; and further wherein said cross-sectional volume of reinforced concrete increases step wise throughout the length of said final section so that said cross-sectional volume of said back end of said final section is comprised entirely of reinforced concrete.

5. The barrier according to claim 4, wherein said plurality of barrier sections are arranged in a linear array so that said first section is positioned closest to a path of oncoming vehicles with the said array extending in a line away from said first section toward said roadside obstacle, in a direction parallel to a line depicting the flow of oncoming vehicles.

6. The barrier according to claim 4, wherein opposed ends of said sections are joined together, said final section being joined to said roadside obstacle.

7. The barrier according to claim 4, wherein opposed ends of said sections are joined together, said final section being joined to an existing reinforced concrete barrier.

8. The barrier according to claim 4, wherein all said barrier sections are arranged in a linear array so that a vehicle impacting said first section in a head-on direction will encounter, in ascending order, a step wise array of lower reinforced concrete sections as said vehicle crushes said lower-density, crushable material positioned above said reinforced concrete in each said section, said crushable material being adapted to impede the forward progress of the vehicle while said step wise array of reinforced concrete sections coact with a portion of an undercarriage of said vehicle to further impede the forward progress of the vehicle through the barrier; the combined effect of said crushable material in each section, and said step wise array of reinforced concrete sections coacting to stop the forward progress of said impacting vehicle.

9. The barrier according to claim 4, wherein the density of the said lower density, crushable material in said first section is less than the density of said lower density, crushable material in said intermediate sections, and said density of said lower density crushable material in said intermediate sections is lower than the density of said lower density, crushable material in said final barrier section.

10. The barrier according to claim 4, wherein said lower density, crushable material is of sufficient strength to deflect a glancing impact from a vehicle in a manner substantially similar to a reinforced concrete barrier.

11. The barrier according to claim 10, wherein the height of said base component of said barrier at said front end of said barrier is less than the road clearance of vehicle impacting said barrier in a head-on direction.

12. The barrier according to claim 11, wherein said height of said base component of said barrier increases in step wise fashion from said front end of said barrier to said back end of said barrier.

13. A composite, highway lane barrier for use at the leading end of a conventional concrete highway lane barrier, comprising:

an elongated composite lane barrier having a lower, substantially non-crushable base component, and an upper crushable top component;

said composite barrier having opposed sidewall surfaces which are inclined upwardly from said base and are configured to deflect a vehicle impacting said barrier at an acute angle, and deflect said impacting vehicle back into a lane of traffic adjacent to said composite structure;

said base component of said barrier being configured to increase in height from a front end of said barrier to a back end of said barrier; said back end of said barrier, being positioned proximate to the leading end of said conventional highway lane barrier, said back end of said barrier being further configured to abut said leading end of said conventional concrete lane barrier; and wherein said upper component of said barrier rests upon, and is attached to, said base component of said barrier.

14. The barrier according to claim 13, wherein the height of said base component at its said back end is greater than the road clearance of vehicle impacting said barrier.

15. The barrier according to claim 14, which further is comprised of a plurality of int sections positioned between, and along the length of, said barrier; said sections interconnecting said front and said back of said barrier; said intermediate sections having variable density crushable top components from said front to said back of said barrier so that said crushable top component of said barrier crushes under the influence of lesser force near said front of said barrier than does the crushable top component of said barrier proximate said back of said barrier, said density of said crushable top components of said intermediate sections increasing in step wise fashion from said front of said barrier to said back barrier.

* * * * *

UNITED STATES PATENT AND TRADEMARK OFFICE

CERTIFICATE OF CORRECTION

PATENT NO. : 4,822,208

DATED : April 18, 1989

INVENTOR(S) : Don L. Ivey

It is certified that error appears in the above-identified patent and that said Letters Patent is hereby corrected as shown below:

Col. 10, line 42, change "int" to --intermediate-.

Signed and Sealed this

Ninth Day of January, 1990

*Attest:*

JEFFREY M. SAMUELS

*Attesting Officer*

*Acting Commissioner of Patents and Trademarks*